US009072951B1

(12) United States Patent
Tang et al.

(10) Patent No.: US 9,072,951 B1
(45) Date of Patent: Jul. 7, 2015

(54) GOLF CLUB HEAD WITH ADJUSTABLE CENTER OF GRAVITY

(71) Applicant: CALLAWAY GOLF COMPANY, Carlsbad, CA (US)

(72) Inventors: Larry Tang, Carlsbad, CA (US); James A. Seluga, Carlsbad, CA (US); Patrick Dawson, San Diego, CA (US); Tim Goudarzi, San Marcos, CA (US); Denver Holt, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 6 days.

(21) Appl. No.: 14/163,216

(22) Filed: Jan. 24, 2014

Related U.S. Application Data

(63) Continuation-in-part of application No. 14/039,102, filed on Sep. 27, 2013, now Pat. No. 8,834,294, which is a continuation-in-part of application No. 13/797,404, filed on Mar. 12, 2013.

(60) Provisional application No. 61/892,884, filed on Oct. 18, 2013, provisional application No. 61/657,247, filed on Jun. 8, 2012, provisional application No. 61/665,203, filed on Jun. 27, 2012, provisional application No. 61/684,079, filed on Aug. 16, 2012.

(51) Int. Cl.
*A63B 53/06* (2015.01)

(52) U.S. Cl.
CPC ..... *A63B 53/06* (2013.01)

(58) Field of Classification Search
CPC ..... A63B 53/06; A63B 2053/0491
USPC ..... 473/333–339
See application file for complete search history.

(56) References Cited

U.S. PATENT DOCUMENTS

| | | | | |
|---|---|---|---|---|
| 7,775,905 | B2 * | 8/2010 | Beach et al. | 473/334 |
| 7,854,364 | B2 * | 12/2010 | DeShiell et al. | 228/177 |
| 8,540,589 | B2 * | 9/2013 | Bezilla et al. | 473/335 |
| 8,591,352 | B2 * | 11/2013 | Hirano | 473/336 |
| 2010/0120552 | A1 * | 5/2010 | Sander et al. | 473/307 |

* cited by examiner

*Primary Examiner* — Stephen Blau
(74) *Attorney, Agent, or Firm* — Rebecca Hanovice; Sonia Lari; Michael A. Catania

(57) ABSTRACT

A golf club head comprising a face, crown, sole, pivoting weight receptacle with a bore, and a weight cartridge sized to removably fit within the bore is disclosed herein. In particular, least one of the crown and the sole comprises a first weight port sized to releasably receive the pivoting weight receptacle, which extends into an interior cavity of the golf club head when the pivoting weight receptacle is fully engaged with the first weight port such that at least part of the pivoting weight receptacle is suspended within the interior cavity and does not make contact with any portion of the golf club head.

13 Claims, 2 Drawing Sheets

GOLF CLUB HEAD WITH ADJUSTABLE CENTER OF GRAVITY

CROSS REFERENCES TO RELATED APPLICATIONS

The present application claims priority to U.S. Provisional Patent Application No. 61/892,884, filed on Oct. 18, 2013, and is a continuation-in-part of U.S. patent application Ser. No. 14/039,102, filed on Sep. 27, 2013, which is a continuation of U.S. patent application Ser. No. 13/797,404, filed on Mar. 12, 2013, which claims priority to U.S. Provisional Patent Application No. 61/657,247, filed on Jun. 8, 2012, 61/665,203, filed on Jun. 27, 2012, and 61/684,079, filed on Aug. 16, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a golf club head with adjustable center of gravity location.

2. Description of the Related Art

The prior art discloses various designs with center of gravity adjustments to improve golf club performance, but fails to provide a golf club with designs that efficiently alter center of gravity parameters and consequentially enable the golf club to be swung faster along its path and contribute to an improved impact event with the golf ball.

The United States Golf Association (USGA) has increasingly limited the performance innovations of golf clubs, particularly drivers. Recently, the USGA has limited the volume, dimensions of the head, such as length, width, and height, face compliance, inertia of driver heads and overall club length. Current methods previously used to improve the performance of a driver have been curtailed by limitations on design parameters set by the USGA. An area of driver performance improvement that exists, as of this date, is the potential to adjust the height of the center of gravity. A change in height of the center of gravity would allow the driver club head to travel faster along its path and contribute to an improved impact event with the golf ball, resulting in higher golf ball velocities and consequentially, in longer golf shots.

The recent past has shown that driver designs have trended to include characteristics to increase the driver's inertia values to help off-center hits go farther and straighter. Driver designs have also recently included larger faces, which may help the driver deliver better feeling shots as well as shots that have higher ball speeds if hit away from the face center. However, these recent trends may also be detrimental to the driver's performance due to the head speed reductions that these design features introduce due to the larger geometries. The design of the present invention allows for higher inertias and robust face design of current drivers in addition to a golf club head design wherein the location, and particularly the height, of the center of gravity is adjustable.

BRIEF SUMMARY OF THE INVENTION

The main objective of the present invention is to improve the location, and particularly the height, of the center of gravity. To improve the height of the center of gravity, a golf club head is created which has center of gravity height adjustment assembly. This multiple designs enabling adjustment of the center of gravity can affect the moment of inertia and ultimately the forgiveness of the golf club head.

Another object of the present invention is an adjustable weighting feature for vertical center of gravity control which is placed to maximize effectiveness and may be entirely concealed from view at address.

One aspect of the present invention is a golf club head comprising a face component, a crown, a sole, a pivoting weight receptacle comprising a bore, and a weight cartridge sized to removably fit within the bore, wherein at least one of the crown and the sole comprises a first weight port sized to releasably receive the pivoting weight receptacle, wherein the pivoting weight receptacle extends into an interior cavity of the golf club head when the pivoting weight receptacle is fully engaged with the first weight port. The weight cartridge may have a heavy end and a lightweight end, and the pivoting weight receptacle may comprise a faceted head and a tubular extension. The first weight port may also comprise an internal surface comprising a structure that securely grips the faceted head of the pivoting weight receptacle so that the tubular extension is suspended within the interior cavity without making contact with any part of the golf club head. This structure may be composed of one or more facets, compressible tabs, and a tight-fitting polymeric material such as rubber. In another embodiment, the golf club head may comprise a channel, which may communicate directly with the interior cavity, such that the first weight port is movable along the channel, or may include a slidable weight sized to fit within the channel.

In another embodiment, the golf club head may also comprise a second weight port and a multi-material weight sized to fit within the second weight port, wherein the multi-material weight may have a first material having a first density and a second material having a second density, the first density may be greater than the second density, the multi-material weight may have a center of gravity and a longitudinal central axis, and the center of gravity may be offset from the central axis. In some embodiments, the multi-material weight may have an elliptical shape, and in other embodiments, the multi-material weight may be affixed within the second weight port with a screw. In some embodiments, the first weight port may be disposed at a rear portion of the sole, and it may comprise internal threads. In a further embodiment, the golf club head may have a cap sized to fit within the first weight port, and the cap may include external threads sized to mate with the internal threads. In some embodiments, the golf club head may be selected from the group consisting of a wood-type head (such as a driver), an iron-type head, a hybrid-type head, and a putter-type head. In some embodiments, at least one of the crown and the sole may be composed of a composite material, and the face may be composed of a metal material. In other embodiments, the golf club head may further comprise first and second weight screws, and may also have second and third weight ports sized to receive the first and second weight screws.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The design approaches described herein are based on the construction used in Callaway Golf Company's RAZR Fit driver head, characterized by a composite crown adhesively bonded to a cast Titanium body, which comprises a face and a sole, and may also comprise a ribbon or skirt portion. However, the embodiments disclosed herein may be used with other golf club head constructions, including but not limited to all Titanium, all composite and composite body with metal face cup. They are also intended to work in conjunction with at least one adjustable weight port on the sole of the golf club head 10.

Figure 1:
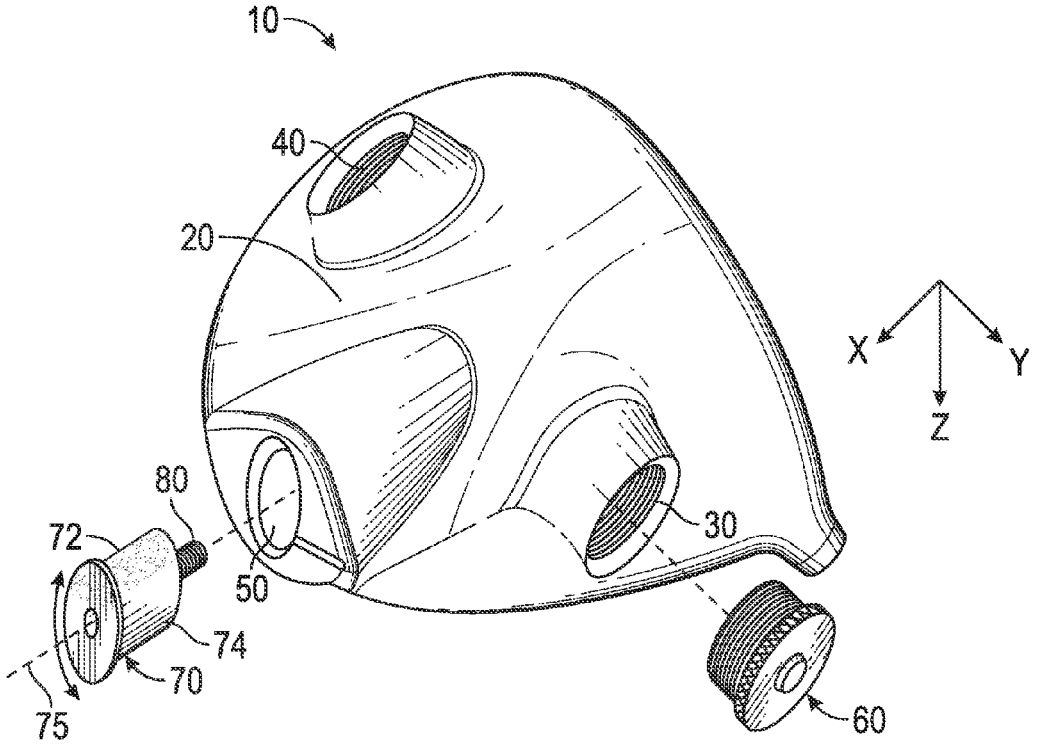
FIG. 1 is a sole perspective view of a first embodiment of the golf club head of the present invention.

In a first embodiment of the present invention shown in FIG. 1, the golf club head 10 includes a sole 20 with a first, heel-side weight port 30, a second, toe-side weight port 40, and a rear weight port 50. The heel- and toe-side weight ports 30, 40 preferably have a circular shape and are sized to receive circular weights 60, while the rear weight port 50 preferably has an elliptical shape and is sized to receive an elliptical weight 70. The elliptical weight 70 is formed from at least two different materials having different densities, such that it has a heavy side 72 and a lightweight side 74. For example, the heavy side 72 may comprise a tungsten alloy, while the lightweight side 74 may comprise a polymeric material. The center of gravity of the elliptical weight 70 preferably is not located on its central axis 75, but is offset towards the heavy side 72. When a user wishes to adjust the center of gravity of the golf club head 10, she can remove the elliptical weight 70 from the rear weight port 50, flip it upside down, and re-attach it to the rear weight port 50, thus adjusting the height of the golf club head's 10 center of gravity.

As shown in this embodiment, the elliptical weight 70 is affixed to the golf club head 10 with a screw 80, but in alternative embodiments may be releasably affixed to the golf club head 10 with semi-permanent adhesives, snap features, or other means known to a person skilled in the art. In alternative embodiments, each of the heel- and toe-side weight ports 30, 40 may also have elliptical shapes and may receive elliptical weights 70 with similar material compositions and center of gravity locations. In further embodiments, the weight ports may have different, polygonal shapes (e.g., rectangular, diamond, rhomboid, star-shaped) with multiple edges, and the weights may also have multiple edges with differing densities such that the center of gravity location of the golf club head 10 can be fine-tuned.

Figure 2:
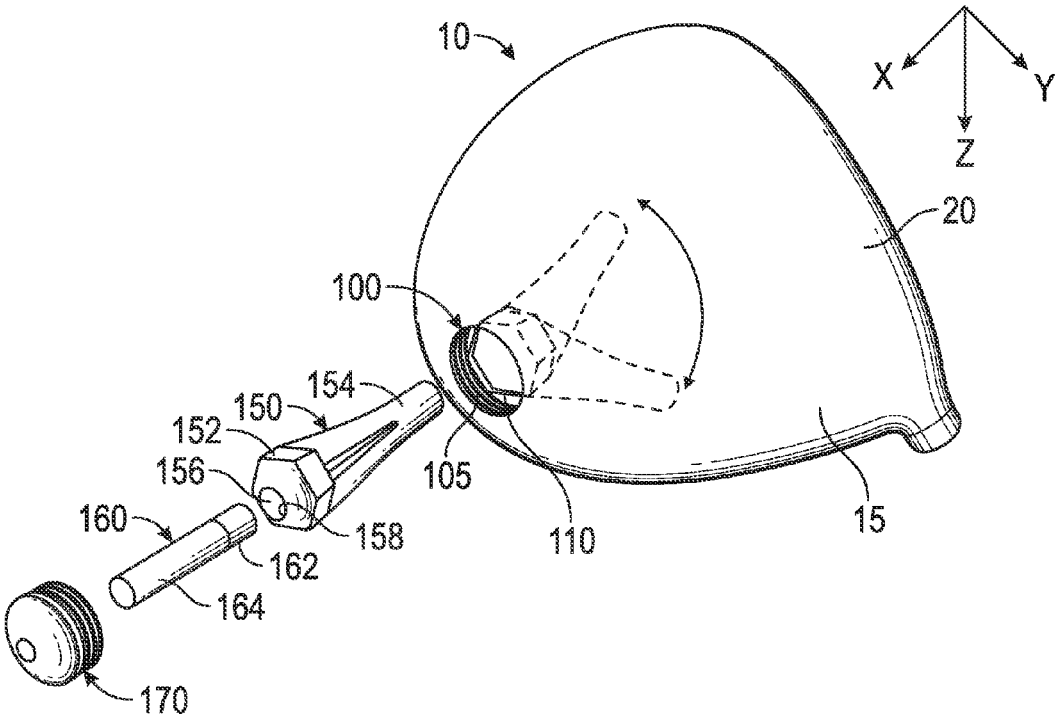
FIG. 2 is a sole perspective view of a second embodiment of the golf club head of the present invention.

In the second, preferred embodiment shown in FIG. 2, the golf club head 10 comprises a rear weight port 100 located in the sole 20 that includes an inner surface 110 shaped to snugly receive the facets of the head 152 of a pivoting weight receptacle 150. The inner surface 110 may include facets, compressible tabs, pliable but tight-fitting polymeric material such as rubber, or other features that securely grip the facets of the head 152 while still allowing the head 152 to move when it is engaged with a tool like a torque wrench or screwdriver. The weight port 100 is a bore that communicates directly with the interior cavity 15 of the golf club head 10.

The weight receptacle comprises a faceted head 152, a tubular extension 154, and a bore 158 that extends from an opening 156 in the head 152 and dead ends within the tubular extension 154. The bore 158 is sized to receive a weight cartridge 160 formed from a plurality of materials such that it has a heavy end 162 and a lightweight end 164. The weight cartridge 160 may have any of the cartridge or carrier features disclosed in U.S. patent application Ser. Nos. 13/797,404, 14/039,102, and 14/159,262, the disclosure of each of which is hereby incorporated by reference in its entirety herein, and can be flipped by the user to adjust the location of the heavy end 162 of the weight cartridge 160 within the pivoting weight receptacle 150.

When the weight cartridge 160 is inserted into the bore 158 of the pivoting weight receptacle 150, the pivoting weight receptacle 150 is inserted into the rear weight port 100 such that the faceted head 152 is snugly received by the inner surface 110 of the weight port 100 and the tubular extension 154 protrudes, unsupported (e.g., suspended), into the interior cavity 15 of the golf club head 10 without making contact with any other part of the golf club head 10. The pivoting weight receptacle 150 is then adjusted with a tool (not shown) and acts like a ball and socket so that the tubular extension 154 points in the direction desired by the user within the interior cavity 15 (and thus relocates the center of gravity location of the golf club head 10), and then the pivoting weight receptacle 150 is fixed in place with a port cap 170 comprising external threads 175 that mate with internal threads 105 located within the weight port 100. The port cap 170 sandwiches the faceted head 152 between the cap and the inner surface 110 of the weight port 100.

Figure 3:
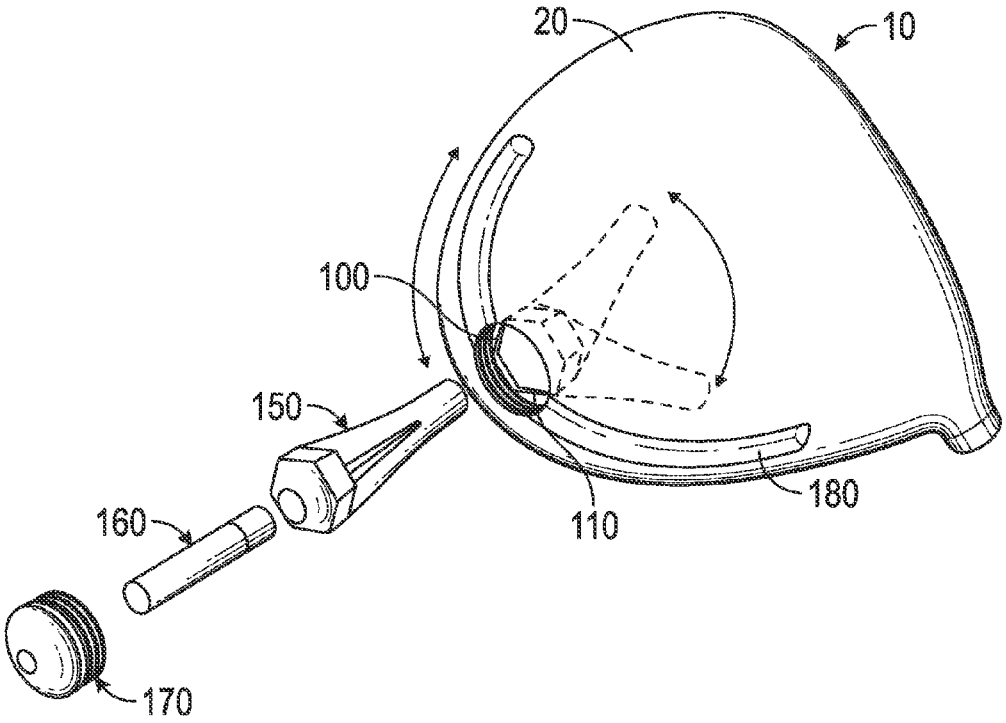
FIG. 3 is a sole perspective view of a third embodiment of the golf club head of the present invention.

In a further embodiment, shown in FIG. 3, the golf club head 10 includes all of the features shown in FIG. 2 and also includes a channel 180 that extends across a portion of the sole 20 along its rear side and is sized to receive a slidable weight, such as the ones disclosed in U.S. patent application Ser. No. 14/033,218, the disclosure of which is hereby incorporated by reference in its entirety herein.

Each of the embodiments disclosed herein are described and shown in combination with a driver-type golf club head, but may also be used with other wood-type golf club heads, irons, hybrids, and putters, which may have any material composition known to a person skilled in the art. They allow a user to adjust the location of the center of gravity along vertical z- and horizontal x- and y-axes, and can disposed anywhere on the body. For example, instead of being located on the rear portion of the sole 20, the weight ports 50, 100 may be located on the crown, face, or in a skirt or ribbon portion (if one exists).

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a face component;

a crown;

a sole;

a pivoting weight receptacle comprising a bore, a faceted head, and a tubular extension; and a weight cartridge sized to removably fit within the bore, wherein at least one of the crown and the sole comprises a first weight port sized to releasably receive the pivoting weight receptacle, wherein the pivoting weight receptacle extends into an interior cavity of the golf club head when the pivoting weight receptacle is fully engaged with the first weight port, and wherein the first weight port comprises an internal surface comprising a structure that securely grips the faceted head of the pivoting weight receptacle when the pivoting weight receptacle is fully engaged with the first weight port, such that the tubular extension is suspended within the interior cavity without making contact with any part of the golf club head.

2. The golf club head of claim 1, wherein the weight cartridge has a heavy end and a lightweight end.

3. The golf club head of claim 1, wherein the structure comprises features selected from the group consisting of facets, compressible tabs, and tightly-fitting polymeric material.

4. The golf club head of claim 1, further comprising a channel.

5. The golf club head of claim 4, further comprising a slidable weight sized to fit within the channel.

6. The golf club head of claim 1, wherein the first weight port is disposed at a rear portion of the sole.

7. The golf club head of claim 1, wherein the first weight port comprises internal threads.

8. The golf club head of claim 7, further comprising a cap sized to fit within the first weight port, wherein the cap comprises external threads sized to mate with the internal threads.

9. The golf club head of claim 1, wherein the golf club head is selected from the group consisting of a wood-type head, an iron-type head, a hybrid-type head, and a putter-type head.

10. The golf club head of claim 9, wherein the golf club head is a wood-type head.

11. The golf club head of claim 10, wherein the golf club head is a driver-type head.

12. The golf club head of claim 1, wherein at least one of the crown and the sole is composed of a composite material.

13. The golf club head of claim 12, wherein the face is composed of a metal material.

* * * * *